US006845300B2

(12) United States Patent
Haghgooie et al.

(10) Patent No.: US 6,845,300 B2
(45) Date of Patent: Jan. 18, 2005

(54) CONTROL METHODS FOR ELECTROMAGNETIC VALVE ACTUATORS

(75) Inventors: Mohammad Haghgooie, Ann Arbor, MI (US); Thomas William Megli, Dearborn, MI (US); Yan Wang, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 258 days.

(21) Appl. No.: 10/037,250

(22) Filed: Jan. 7, 2002

(65) Prior Publication Data

US 2003/0130764 A1 Jul. 10, 2003

(51) Int. Cl.[7] ..... G05D 11/00

(52) U.S. Cl. ..... 700/289; 700/282; 700/275; 361/160; 361/152; 361/154; 361/210; 361/187; 361/206; 361/194

(58) Field of Search ..... 700/282, 289; 361/160, 152, 154, 210, 187, 206, 194; 251/129.22, 129.04, 129.09, 129.15, 129.2

(56) References Cited

U.S. PATENT DOCUMENTS 4,453,652 A * 6/1984 Merkel et al. ..... 222/504
5,074,259 A * 12/1991 Pusic ..... 123/90.11
5,119,772 A 6/1992 Kawamura
5,293,551 A * 3/1994 Perkins et al. ..... 361/154
5,592,905 A * 1/1997 Born ..... 123/90.11
5,650,909 A * 7/1997 Remele et al. ..... 361/154
5,748,433 A 5/1998 Schrey et al.
6,166,896 A * 12/2000 Schmitz ..... 361/187
6,209,513 B1 * 4/2001 Sakasai et al. ..... 123/299
6,249,418 B1 * 6/2001 Bergstrom ..... 361/152
6,494,187 B2 * 12/2002 Giavi et al. ..... 123/490
6,565,064 B2 * 5/2003 Smith et al. ..... 251/129.04

* cited by examiner

*Primary Examiner*—Anthony Knight
*Assistant Examiner*—Thomas Pham
(74) *Attorney, Agent, or Firm*—Allan J. Lippa

(57) ABSTRACT

An electromagnetically operated valve assembly (28) has a first solenoid (58) and a second solenoid (60). An armature (56) having a valve stem (54) coupled thereto is positioned between the first solenoid (58) and second solenoid (60). A controller (12) is coupled to the first solenoid (58), the second solenoid (60). A current sensor (49) is coupled to the first solenoid and generated a signal corresponding to the induced current in the first solenoid. The controller (12) changes a voltage applied to the first solenoid from a first polarity to a second polarity. The controller (12) is further configured to hold the voltage at the second polarity for a predetermined time period and a predetermined amplitude to decrease the induced current. The predetermined time period or the predetermined amplitude is determined based on the first signal.

18 Claims, 4 Drawing Sheets

CONTROL METHODS FOR ELECTROMAGNETIC VALVE ACTUATORS

TECHNICAL FIELD

The present invention relates generally to controlling an electromagnetic valve actuator, and more particularly to a control method for electromagnetic engine valve actuation to reduce power consumption therewith.

BACKGROUND OF THE INVENTION

Typically in an internal combustion engine, the intake and exhaust valves are controlled mechanically. The valves are mechanically controlled by the camshaft of the engine and thus there is limited flexibility in the control of the valves. Valve control is extremely important for optimizing fuel economy and reducing emissions. Therefore, flexibility is highly desirable in valve control.

It is known in the art to employ electromagnetically driven valve actuators in an internal combustion engine. Typically, these known systems require power circuits having high frequency switching devices in order to handle the voltage differences required to properly control the valves. Additionally, the control of the valve timing is critical and therefore, is the subject of much consideration.

A typical electromagnetic valve system includes a first solenoid coil spaced apart from a second solenoid coil. An armature mechanically contacting a valve stem moves between the first armature coil and the second armature coil. A pair of springs is used to return the armature to an at rest position between the first solenoid coil and the second solenoid coil. Thus, to open the valve the lower solenoid coil electromagnetically draws the armature thereto against the spring force. To close the valve the upper solenoid is engaged to draw the armature toward the second solenoid. Known systems operate, for example, with one solenoid coil on while the other solenoid coil is off and in reverse for a reverse position of the valve.

Another known system is found in U.S. Pat. No. 5,748,433. In this system, a solenoid is provided with a current in a first direction for holding the armature in a predetermined direction. The current is then interrupted and a reverse polarity current pulse is provided to the solenoid after a predetermined time period. In this configuration the pulse applied is fixed in duration and thus cannot account for operating conditions of the vehicle, wear or manufacturing tolerances. By not compensating for these factors, the amount of energy used in the reverse polarity pulse may be greater than necessary. By waiting to apply the reverse polarity current pulse, more energy must be consumed to overcome the momentum of the valve. Therefore, the system is believed to have increased energy consumption which reduces the fuel economy of the engine.

It would therefore be desirable to reduce the power consumption of a valve operation system for an engine of an automotive vehicle to realize fuel economy.

SUMMARY OF THE INVENTION

The present invention reduces the amount of energy required to operate the valve system. In one aspect of the invention, a system for controlling an electromagnetic valve assembly that has a first solenoid, a second solenoid, and an armature positioned between the first solenoid and the second solenoid. A controller is coupled to the first solenoid, the second solenoid. A current sensor is coupled to the first solenoid and generated a signal corresponding to the induced current in the first solenoid. The controller changes a voltage applied to the first solenoid from a first polarity to a second polarity. The controller is further configured to hold the voltage at the second polarity for a predetermined time period and a predetermined amplitude to decrease the induced current. The predetermined time period or the predetermined amplitude is determined based on the first signal.

In a further aspect of the invention, a method for controlling an electromechanical valve assembly provided. The valve assembly has a first solenoid, a second solenoid and a valve armature positioned between the first solenoid and the second solenoid. The method includes changing a voltage applied to the first solenoid from a first polarity to a second polarity, measuring an induced current in the first solenoid, and holding the voltage at the second polarity for a predetermined time period at a predetermined amplitude to decrease the induced current. The predetermined time period or the predetermined amplitude being determined based on the induced current.

One advantage of the invention is that the fuel economy of the vehicle may be reduced through reduction in the valve power consumption. Another advantage of the invention is that engine wear is compensated for in the system by monitoring induced current through the coils. Variations in the cylinder head assembly and manufacturing process are also compensated for in the control system of the present invention. Both the engine wear and manufacturing variability are compensated for by adjusting the pulse-width in response to the measured current.

Other aspects and advantages of the invention will become apparent upon reading the following detailed description and appended claims, and upon reference to the accompanying drawings.

DETAILED DESCRIPTION OF PREFERRED EMBODIMENTS

Figure 1:
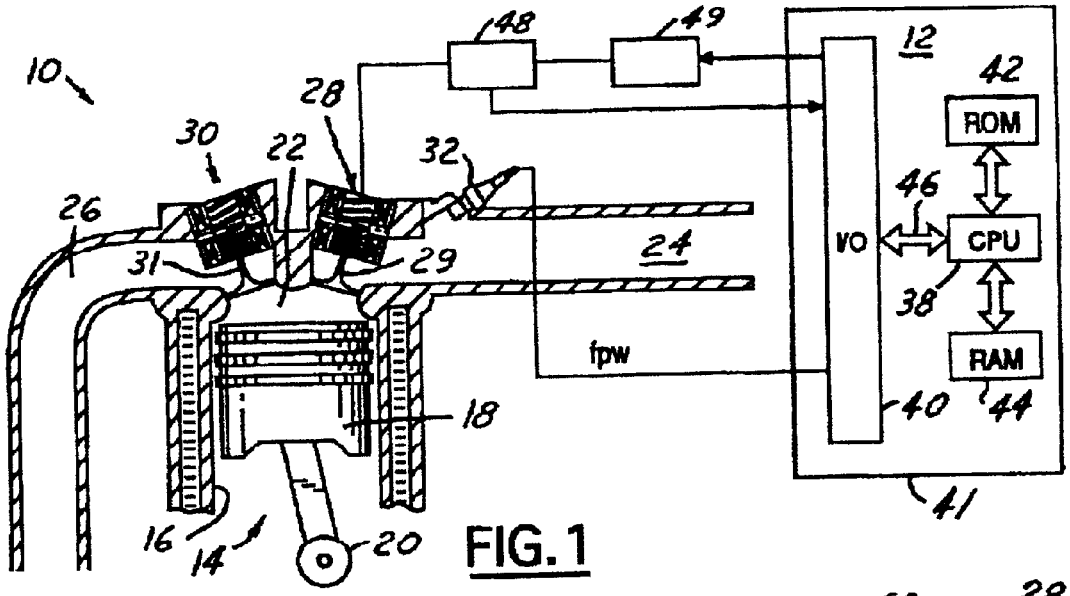
FIG. 1 is a block diagrammatic view of an automotive vehicle having a valve train and controller according to the present invention.

Referring now to FIG. 1, internal combustion engine 10 is controlled by electronic controller 12. Engine 10 has a plurality of cylinders 14, one of which is shown. Each cylinder has a cylinder wall 16 and a piston 18 positioned therein and connected to a crankshaft 20. A combustion chamber 22 is defined between piston 18 and cylinder wall 16. Combustion chamber 22 communicates between intake manifold 24 and exhaust manifold 26 via a respective intake valve assembly 28 and an exhaust valve assembly 30. Intake manifold 24 is also shown having fuel injector 32 coupled thereto for delivering liquid fuel in proportion to the pulse-width of signal (FPW) from controller 12. Those skilled in the art will also recognize that engine may be configured such that the fuel is injected directly into the cylinder of the engine in a direct injection type system.

Valve assemblies 28, 30. at least one of which is electromagnetically operated, have a respective intake valve 29 and exhaust valve 31. Various numbers of valves may be provided within an engine 10. The number of valve assemblies depends on the number of cylinders of engine 10 and the number of inlet ports and outlet ports for the cylinder. One inlet port and one outlet port are common. However, four valves per cylinder, including two inlet valves and outlet valve, are also common. Both the inlet valves and outlet valves of engine 10 may be operated electromagnetically according to the present invention.

Controller 12 controls the operation of the valves assemblies 28, 30 including the relative timing and duration of the opening and closing thereof. Controller 12 is shown as a conventional microcomputer including a microprocessing unit (CPU) 38, input/output ports 40, computer storage medium read-only memory 42 and random access memory 44, and a conventional data bus 46 therebetween. Controller 12 may for example, be a microprocessor-based engine control module. Although only one controller 12 is illustrated, more than one controller or microprocessor may be used to form controller 12. The computer storage medium stores the code that performs the method of the present invention.

A current sensor 48 and current driver 49 are coupled between valve assembly 28 and controller 12. Although only one current sensor 48 is illustrated, each electrically controlled solenoid may have a current sensor. Sensor 48 generates an electrical signal corresponding to the current I that is coupled to the coil. Suitable types of sensors include a precision resistor or a hall effect device. Of course, those skilled in the art will recognize various types of current sensors may be employed.

Current driver 49 drives the current I of the electromagnetic valve in response to a control signal from controller 12. As will be further described below, current driver is capable of applying current in two directions in response to reverse polarity voltage commands.

Figure 2A:
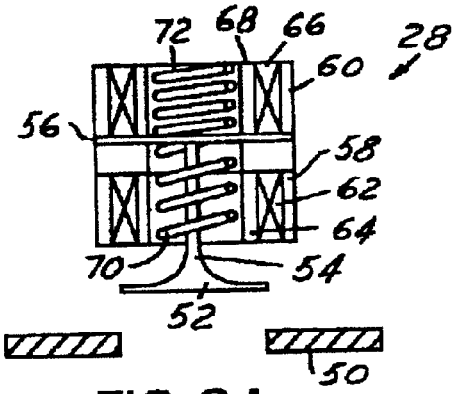
FIG. 2A is a sectional view of an electromagnetically driven intake valve, which is controlled according to an embodiment of the present invention in a open position.
Figure 2B:
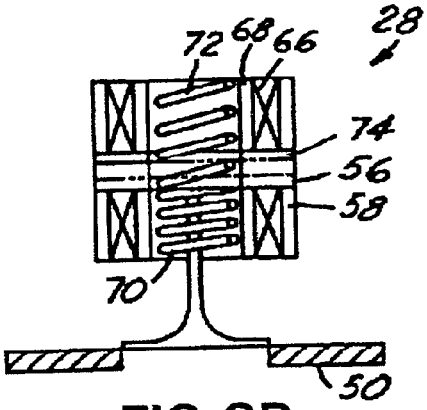
FIG. 2B is a sectional view of an electromagnetically driven intake valve, which is controlled according to an embodiment of the present invention in a closed position.

Referring now to FIGS. 2A and 2B, electromagnetically operated valve assembly 28 is illustrated in a respective opened position and closed position relative to a valve seat 50. Electromagnetically operated valve assembly 28 has a valve element 52 having a valve stem 54 that has an armature 56 secured thereto. As mentioned above, valve element 58 may be an intake valve or an exhaust valve operated according to the present invention described below.

Valve element 52 is driven by two opposing solenoids 58, 60. Solenoid 60 is referred to as an opening solenoid. Solenoid 58 is referred to as a closing solenoid. Closing solenoid 58 biases armature 56 in a downward and thus closed direction when current is passed therethrough. Opening solenoid 60 biases the armature 56 in an open position when current is passed therethrough as is best shown in FIG. 2A. Closing solenoid has a coil 64 and a core 62. Likewise, opening solenoid 60 has a core 68 and a coil 66. Each core and coil combination essentially forms an electromagnet that is used to attract armature 56 thereto when the coils have current passed therethrough.

A pair of opposed springs 70, 72 are coupled to valve element 52 to bias the valve element 52 in a neutral position 74 between closing solenoid 60 and opening solenoid 58. The springs 70 and 72 are pre-loaded so that both the springs are compressed during the armature travel and the equilibrium is at the middle position of the travel. The combination of springs 70 and 72 biases armature 56 in an upward position when armature 56 is positioned against opening solenoid 58 and in a downward position when armature 56 is positioned against closing solenoid 60. Consequently, neutral position 74 is formed between closing solenoid 60 and opening solenoid 58 when springs 60, 62 achieve equilibrium and no magnetic forces are present in solenoids 58, 60. Thus, when the closing solenoid 60 is activated, armature 56 overcomes the spring forces and is driven upward. When opening solenoid is energized, armature 56 moves downward and overcomes the spring forces. When neither coil is energized armature 56 and thus valve element 52 remains in a neutral position between a fully open position and a fully closed position.

Figure 3:
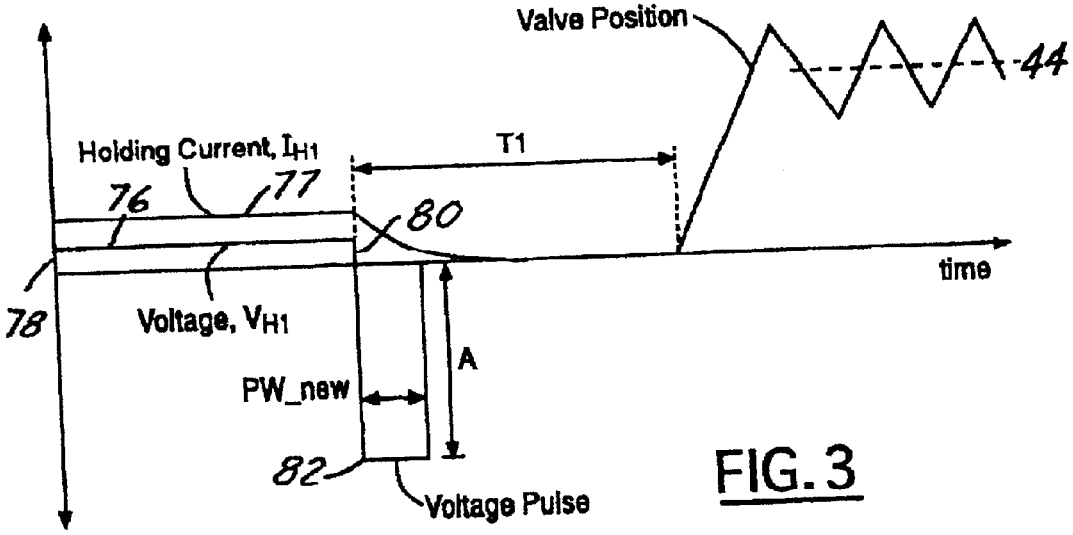
FIG. 3 is a plot of the voltage through the coil and valve position relative to time.

Referring now to FIG. 3, a voltage plot for operating opening solenoid 58 of FIG. 2B is illustrated. Opening solenoid 58 is provided a holding voltage 76 with a first polarity which provides a positive holding current 77 therethrough. Holding voltage 66 has a start edge 78 and an end edge 80 which delineates the coil duty cycle therebetween. The controller 12 controls the application of the positive voltage pulse to the solenoid. A release command is generated at controller 12 that forms end edge 80. Simultaneously with end edge 50, a reverse or negative polarity pulse is generated. Reverse polarity pulse 82 is controlled by controller 12 of FIG. 1. Reverse polarity pulse 82 has pulse characteristics such as pulse-width PW_New and amplitude A_New. In one embodiment of the invention, at least one pulse characteristic is variable. That is, either the pulse-width or pulse amplitude may be varied during the operation of the vehicle to reduce energy losses. This is valuable in a manufactured product environment because engine wear and variability in the cylinder head assembly process as well as engine load, speed and temperature may be compensated for by providing variable pulse-widths. Further, the need for tuning a particular pulse-width for the particular engine may be eliminated by the use of the variable pulse-width. By monitoring the feedback current, the pulse characteristic can be varied to drive the induce current rapidly to zero and reduce the amount of energy needed for the subsequent coil.

In FIG. 3, after a time delay T1 after end edge 80, the valve position 82 is plotted. As can be seen, the valve position oscillates about the neutral position 74 between the solenoids 58, 60.

Figure 4:
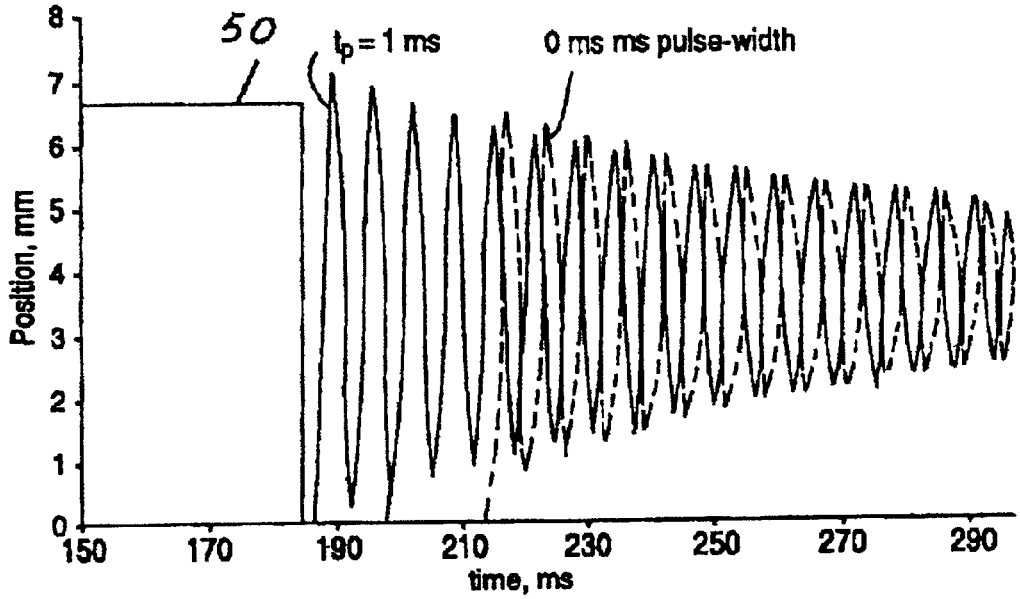
FIG. 4 illustrates various valve positions for various pulse-widths versus time.

Referring now to FIG. 4, a plot of valve position versus time for a pulse-width of 1 millisecond and no pulse is illustrated. The release command and the voltage at the second polarity is generated by the controller at end edge 80. As can be seen, with a zero millisecond pulse-width, i.e., no pulse-width, a 30 millisecond time delay T1 was observed. By increasing the pulse-width to 1 millisecond only about 1 millisecond time delay T1 was observed before the valve began to return to the neutral position. By adding the negative polarity pulse, mechanical energy loss during valve transition was significantly reduced. This can be observed in the plot by comparing the valve position at the end of the first swing of the free oscillations illustrated. That is, for no pulse-width the valve position reaches about 6.5 millimeters while for the pulse-width of 1 millisecond the valve reaches a position of 7.2 millimeters. A mechanical energy saving thus reduces power consumption because the power to the opposite solenoid can thus be reduced. The mechanical energy savings are realized because the reverse polarity pulse reduces the current and therefore magnetic flux coupling between the armature and coil near the lift-off point.

Figure 5:
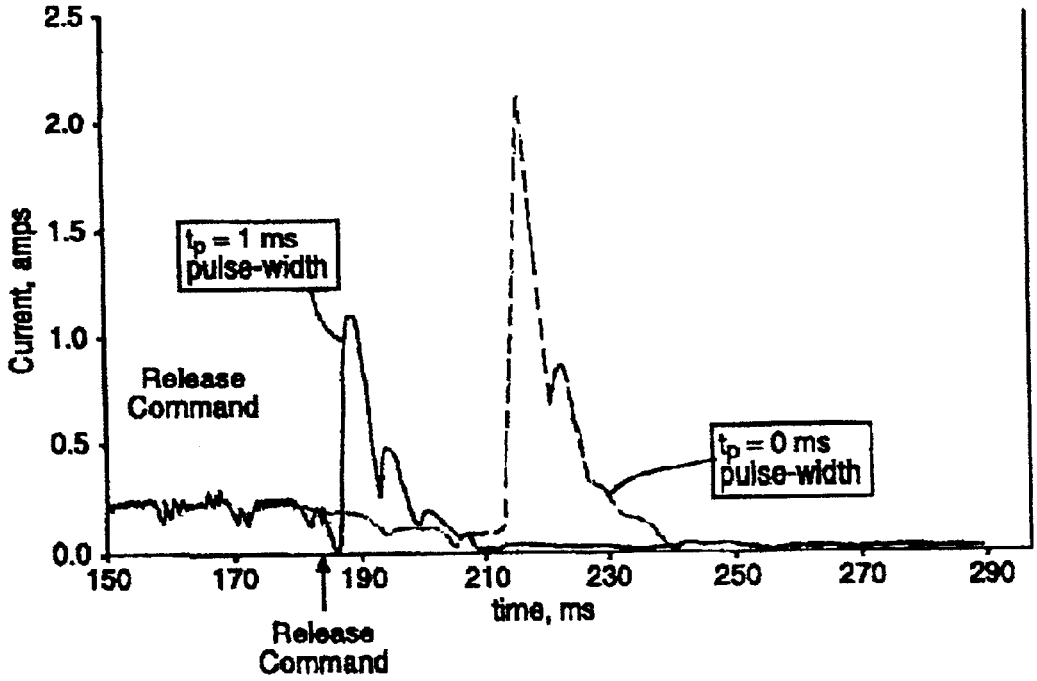
FIG. 5 is a plot of current and valve position versus time.

Referring now to FIG. 5, current responses for no pulse-width ($t_p$=0 ms) and a pulse-width ($t_p$=1 ms) are illustrated. Without a reverse polarity pulse the negative armature motion generates a substantial voltage across the coil due to the changing magnetic flux in accordance with Faraday's law. As is illustrated, the resulting current reaches approximately 2 amps and is eventually dissipated in the coil and power stage resistance. With a reverse pulse-width of 1 millisecond, the current and magnetic flux are reduced near the lift-off point and the electrical energy generated by the armature motion is reduced as the current reaches a peak of about 1.2 amps. The time delay is also reduced with the reverse voltage pulse since the current decays rapidly from the holding level. This reduces the magnetic holding force faster and the armature begins to move away from the solenoid sooner.

Figure 6:
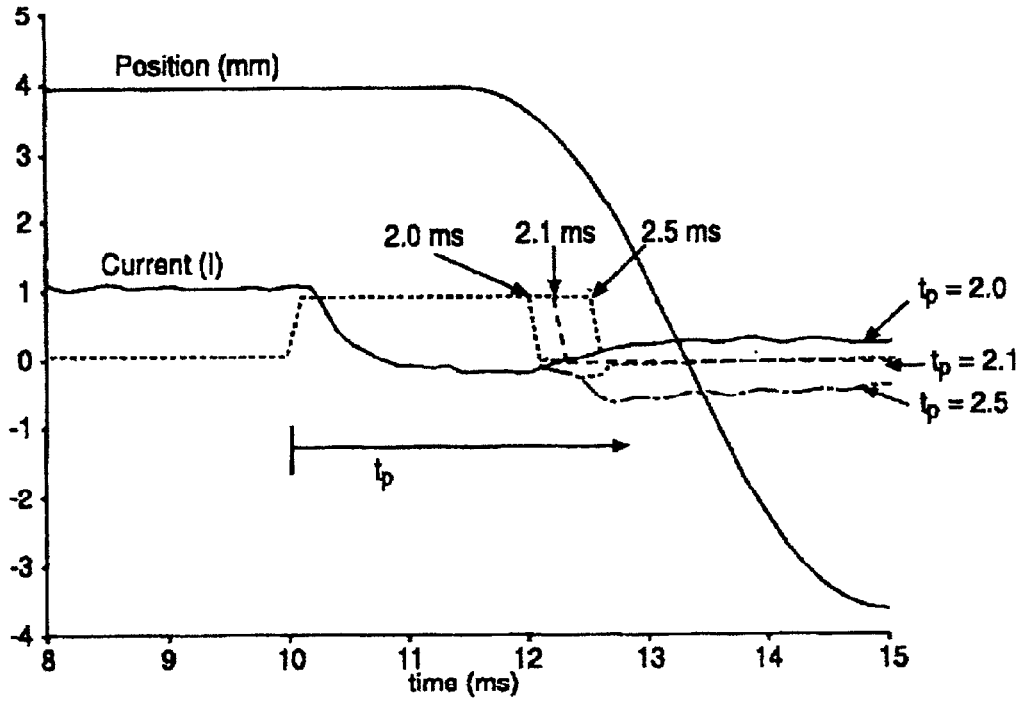
FIG. 6 is current plot for various pulse-widths that are used to eliminate electrical losses in the solenoid coil.

Referring now to FIG. 6, a current peak in the induced current is still found in FIG. 5 when the pulse-width was 1 millisecond. The current peak was analyzed and it was determined that about 70 mJ of energy savings may be possible if the current peak is eliminated. Various pulse-widths $t_p$ were used in FIG. 6. Pulse-widths of 2.0, 2.1, and 2.5 milliseconds were compared. Corresponding induced currents are plotted for the different pulse-widths. The currents for each are the same and are thus superimposed on the left portion of the plot. The currents diverge at the end of the pulse. As can be seen, a small positive peak was noted for a 2.0 millisecond pulse-width while a negative current began to flow using 2.5 milliseconds. For a 2.1 millisecond pulse-width, the current peak was virtually eliminated. Thus, the key to minimizing electrical energy loss is to find an optimal pulse-width to drive the current and magnetic flux to zero at the armature lift-off point. Thus, by monitoring current within the solenoid coils the pulse-width may be adjusted to be between a positive peak and a negative current.

Referring now also to FIG. 3, one way in which the pulse-width may be determined is using a simple linear correction on the following equation:

$$PW_New = PW_Old + k*I$$

where PW_New is the corrected pulse-width based on the last pulse-width PW_Old, a positive gain k, and a current I. The current I is a peak magnitude during a time interval near the lift-off event. For example, in FIG. 6 the interval would be between about 12 to 14 ms, or about the first 2 ms of the transition. For the 2.5 ms pulse-width, the peak magnitude gives I=−0.5 A, which then would reduce the pulse-width for the next transition. Similarly for 2.0 ms, the peak magnitude would be I=0.5 A which would increase the pulse-width according to the above equation.

Likewise, the amplitude may also be adjusted in a similar manner to the pulse-width. That is, $A_New = A_Old + k_1 * I$ when A_New is the corrected amplitude based on the latest amplitude A_Old, a positive gain $k_1$ and current I.

Figure 8:
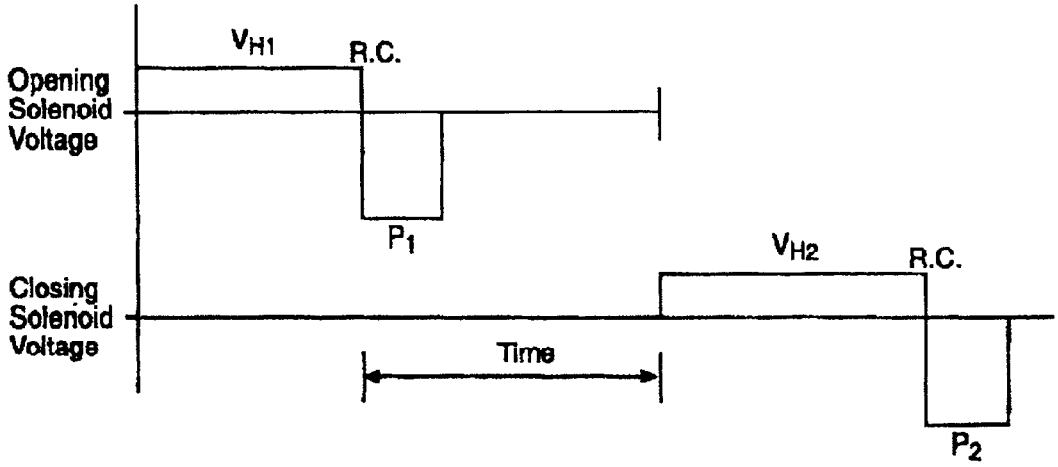
FIG. 8 is a plot of holding current versus time for an opening solenoid and a closing solenoid.
Figure 7:
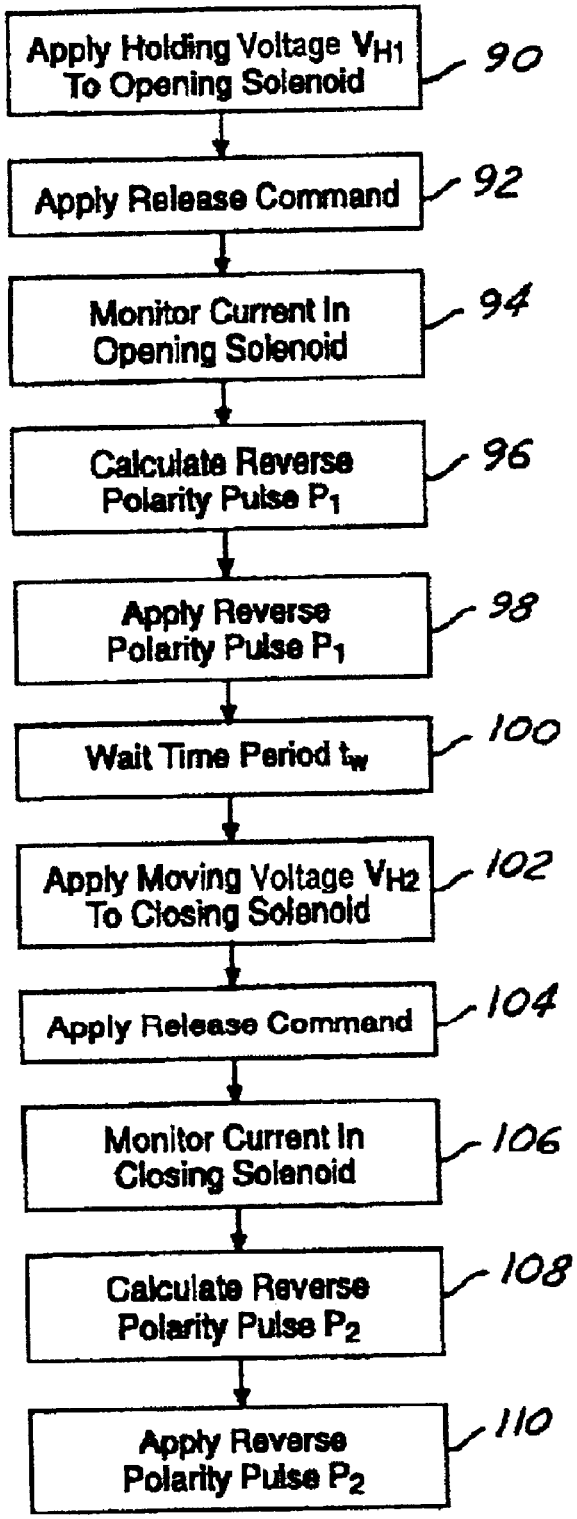
FIG. 7 is a flow chart of the operation of the controller according to the present invention.

Referring now to FIGS. 7 and 8, the operation of the magnetically operated valve assembly is illustrated in further detail. Such operation may be implemented in software code stored in the computer storage medium described above. In the present example, the valve element 52 will be moved from an open position to a closed position. In step 90, a holding voltage $V_{H1}$ is applied to the opening solenoid. A release command (R.C.) is generated by the controller when the holding voltage $V_{H1}$ transitions to a negative voltage level. In step 64, the current in the opening solenoid is monitored. This monitoring step may be performed continuously and therefore may occur before applying release command 92. Based upon the current in the coil, a reverse polarity pulse may be calculated in the controller in step 96 as described above in reference to FIG. 6. As mentioned above, the pulse-width may vary, the amplitude or both may vary. The reverse polarity pulse $P_1$ is applied to the opening solenoid in step 98. By applying the reverse polarity voltage pulse in step 98 the energy required for the closing solenoid may be reduced. The closing solenoid is activated after a time period $t_w$ is applied in step 100. Time period $t_w$ is based upon the timing of the operation of the engine which varies depending on the operating conditions of the vehicle. In step 102 a holding voltage $VH_2$ is applied to the closing solenoid. A release command is applied in step 104 so that the holding voltage ceases. In a similar manner to that described above, the current in the closing solenoid may also be monitored in step 106. A reverse polarity pulse may then be calculated in step 108 based upon the current in step 106. A reverse polarity $P_2$ may the be applied to the closing solenoid. The steps performed may then be repeated during the operation of the electromechanical valve. The present invention may actually act on a delay in that the monitored current may be used in the calculation of a subsequent pulse.

As can be seen above, the present invention advantageously improves overall fuel economy for the vehicle by reducing the valve train power consumption. Adjustments may be made in the system for engine wear and variability in the manufacturing process of the cylinder head. Changes in load, speed and temperature may also be factored into the calculation for the reverse polarity pulse. It should be also noted that the profile of the pulse-width may also be changed to a target profile to further tailor the pulse-width to reduce energy consumption. These changes may be experimentally determined for various mechanical configurations possible with the present invention.

While particular embodiments of the invention have been shown and described, numerous variations and alternate embodiments will occur to those skilled in the art. Accordingly, it is intended that the invention be limited only in terms of the appended claims.

We claim:

1. A method for controlling an electromechanical valve assembly, said valve assembly having a first solenoid, a second solenoid and an valve armature positioned between said first solenoid and said second solenoid, said method comprising:

changing a voltage applied to said first solenoid from a first polarity to a second polarity;

measuring an induced current in said first solenoid; and, holding said voltage at said second polarity for a predetermined time period at a predetermined amplitude to decrease said induced current, said predetermined time period or said predetermined amplitude being determined based on said induced current.

2. The method of claim 1 further comprising increasing said first predetermined time period when said induced current has a positive value.

3. The method of claim 1 further comprising increasing said predetermined amplitude when said induced current has a positive value.

4. The method of claim 1 further comprising decreasing said first predetermined time period when said current has a negative value.

5. The method of claim 1 further comprising decreasing said predetermined amplitude when said current has a negative value.

6. The method of claim 1 wherein said first polarity is a positive polarity and said second polarity is a negative polarity.

7. A system for controlling an electromechanical valve assembly, said valve assembly having a first solenoid, a second solenoid and a valve armature positioned between said first solenoid and said second solenoid, said system comprising:

a current sensor for generating a first signal indicative of an induced current level in said first solenoid; and, a controller operably connected to said current sensor, said controller being configured to change a voltage applied to said first solenoid from a first polarity to a second polarity, said controller being further configured to hold said voltage at said second polarity for a predetermined time period and a predetermined amplitude to decrease said induced current, said predetermined time period or said predetermined amplitude being determined based on said first signal.

8. The system of claim 7 wherein said first predetermined time period is increased when said induced current has a positive value.

9. The system of claim 7 wherein said predetermined amplitude is increased when said induced current has a positive value.

10. The system of claim 7 wherein said first predetermined time period is decreased when said current has a negative value.

11. The system of claim 7 wherein said predetermined amplitude is decreased when said current has a negative value.

12. The system of claim 7 wherein said first polarity is a positive polarity and said second polarity is a negative polarity.

13. The system of claim 7 wherein said controller generates a release command to change the voltage.

14. An article of manufacture comprising:

a computer storage medium having a computer program encoded therein for controlling an electromechanical valve assembly, said valve assembly having first and second solenoids and an valve armature positioned between said first and second solenoids, said computer storage medium comprising:

code for changing a voltage applied to said first solenoid from a first polarity to a second polarity;

code for measuring an induced current in said first solenoid; and, code for holding said voltage at said second polarity for a predetermined time period and a predetermined amplitude to decrease said induced current, said predetermined time period or said predetermined amplitude being determined based on said induced current.

15. The article of claim 14 wherein said computer storage medium further comprises code for increasing said first predetermined time period when said induced current has a positive value.

16. The article of claim 14 wherein said computer storage medium further comprises code for increasing said predetermined amplitude when said induced current has a positive value.

17. The article of claim 14 wherein said computer storage medium further comprises code for decreasing said first predetermined time period when said current has a negative value.

18. The article of claim 14 wherein said computer storage medium further comprises code for decreasing said predetermined amplitude when said current has a negative value.

* * * * *